US005143256A

United States Patent [19]

Wadensten

[11] Patent Number: 5,143,256

[45] Date of Patent: Sep. 1, 1992

[54] GAS ACCUMULATOR AND BLASTER APPARATUS

[76] Inventor: Theodore S. Wadensten, P.O. Box 9, Wyoming, R.I. 07068

[21] Appl. No.: 689,467

[22] Filed: Apr. 22, 1991

[51] Int. Cl.[5] ..... B65G 69/00

[52] U.S. Cl. ..... 222/3; 222/195; 406/85; 406/136; 406/137; 251/25; 251/144

[58] Field of Search ..... 222/3, 195; 406/85, 406/136, 137; 251/144, 25

[56] References Cited

U.S. PATENT DOCUMENTS

| | | | |
|---|---|---|---|
| 4,346,822 | 8/1982 | Wadensten et al. | 222/195 |
| 4,579,138 | 4/1986 | Simoens | 222/195 X |
| 4,739,964 | 4/1988 | Hutt | 222/195 X |
| 4,817,821 | 4/1989 | Simoens | 222/195 X |
| 4,880,147 | 11/1989 | Tolan | 222/195 |

*Primary Examiner*—Andres Kashnikow
*Assistant Examiner*—Anthoula Pomrening
*Attorney, Agent, or Firm*—Patrick J. Pinto

[57] ABSTRACT

A gas accumulator and blaster apparatus including a pressure tank (12) and a quick release valve (14). The quick release valve includes an elongated outer sleeve (22), an end cap (28), a check valve (32), a shouldered guide member (38), a cup shaped piston (56), and an annular seat member (68). The tank is filled with a gas by means of a conduit (36). The gas accumulated in the tank is quickly exhausted through a second end (26) of the quick release valve and into a storage bin as and when gas is exhausted from interior of the piston, guide member, and conduit. The piston quickly returns to a closed position as and when the flow of air from said tank stops.

12 Claims, 2 Drawing Sheets

GAS ACCUMULATOR AND BLASTER APPARATUS

BACKGROUND OF THE INVENTION

1. Field of the Invention

This invention is believed to be found in the field of dispensing, and more particularly in the field of dispensing of a gas or vapor.

Gas accumulators and blaster apparatus are known in the prior art. This type of apparatus is adapted for mounting to the side of a storage bin, in which granular materials are kept The function of a gas accumulator and blaster apparatus is to dislodge any of the granular material which has become blocked or bridged within the storage bin. Some of the known prior art includes U.S. Pat. No. 3,915,339 as issued to Matson on Oct. 28, 1975; U.S. Pat. No. 3,788,527 as issued to Matson on Jan. 29, 1974; U.S. Pat. No. 4,197,966 as issued to the present applicant on Jul. 15, 1980; U.S. Pat. No. 4,469,247 as issued to Tompkins on Sep. 04, 1984; U.S. Pat. No. 4,676,402 as issued to Stetson on Jun. 30, 1987; U.S. Pat. No. 4,703,869 as issued to De Rooy on Nov. 3, 1987; U.S. Pat. No. 4,767,024 as issued to Rappen on Aug. 30, 1988; U.S. Pat. No. 4,819,821 as issued to Simoens on Apr. 4, 1989; and U.S. Pat. No. 4,440,147 as issued to Tolan on Nov. 14, 1989.

The above listed known prior art patents show or disclose a piston member which is used to control the direction of flow of a gas or vapor which has been collected under pressure in a tank. Many of these patents disclose peripheral sealing means between the piston and its associated cylinder wall. Many of the prior art systems use spring means to urge the piston to a closed condition.

Peripheral seals between the piston and the wall of the cylinder increase the forces necessary to move the piston from an open to a closed position. This force may be referred to as a "break away force". The employment of a spring also adds to these "break away forces". It has been found that valuable time is lost in opening and closing the valve when peripheral seals and/or springs are used. Any delay in the closing of the valve, after all the pressurized gas is expelled from the tank, may allow dust from the storage bin to contaminate the piston, the seal, and/or the cylinder wall. Any contamination of these items will not only increase the opening or closing times of the blaster but can cause unwanted leakage of gas.

It has also been found that known blaster apparatus utilizing a piston type valve require that the piston and its associated cylinder be machined and matched in pairs to provide the desired smooth operation.

The present invention is believed to overcome some of the known problems which have been identified above by using (1) a movable piston which does not use a peripheral seal; (2) gravity is used to immediately close the valve member when pressure has dropped substantially to atmosphere; (3) containment of any undesirable particles which may be carried in the feeding air line. There is also a need to provide a low cost system which will fit interior of standard tubing or pipe.

SUMMARY OF THE INVENTION

This invention may be summarized, at least in part, with respect to its objects It is an object of this invention to provide and it does provide an air accumulator and blaster apparatus which will fit interior of standard sized tubing or pipe.

It is another object of this invention to provide an air accumulator and blaster apparatus having a quick release valve which is quickly responsive when and as desired.

It is a further object of this invention to provide an air accumulator and blaster apparatus which minimizes the entry of contaminants into the pressure tank.

In addition to the above summary, the following disclosure is detailed to insure adequacy and aid in the understanding of this present invention. This disclosure, however, is not intended to cover each new and inventive concept, no matter how it may later be disguised by variations in form, additions, or by further improvements. For this reason, there has been chosen specific embodiments of a gas accumulator and blaster apparatus. These specific embodiments have been chosen for the purpose of illustration and description, as shown in the accompanying drawings wherein:

BRIEF DESCRIPTION OF THE DRAWING

In the following description and in the claims, various details are identified by specific names for convenience. These names are intended to be generic in their application. The corresponding reference characters refer to like members throughout the several figures of the drawings.

The drawings accompanying, and forming a part of this specification disclose certain details of construction associated with a gas accumulator and blaster apparatus. These details are only for the purpose of explanation, but structural details may be modified without departing from the concept and principles of the present invention. It is anticipated that this invention may be incorporated into forms other than as shown.

DESCRIPTION OF THE EMBODIMENT

Figure 1:
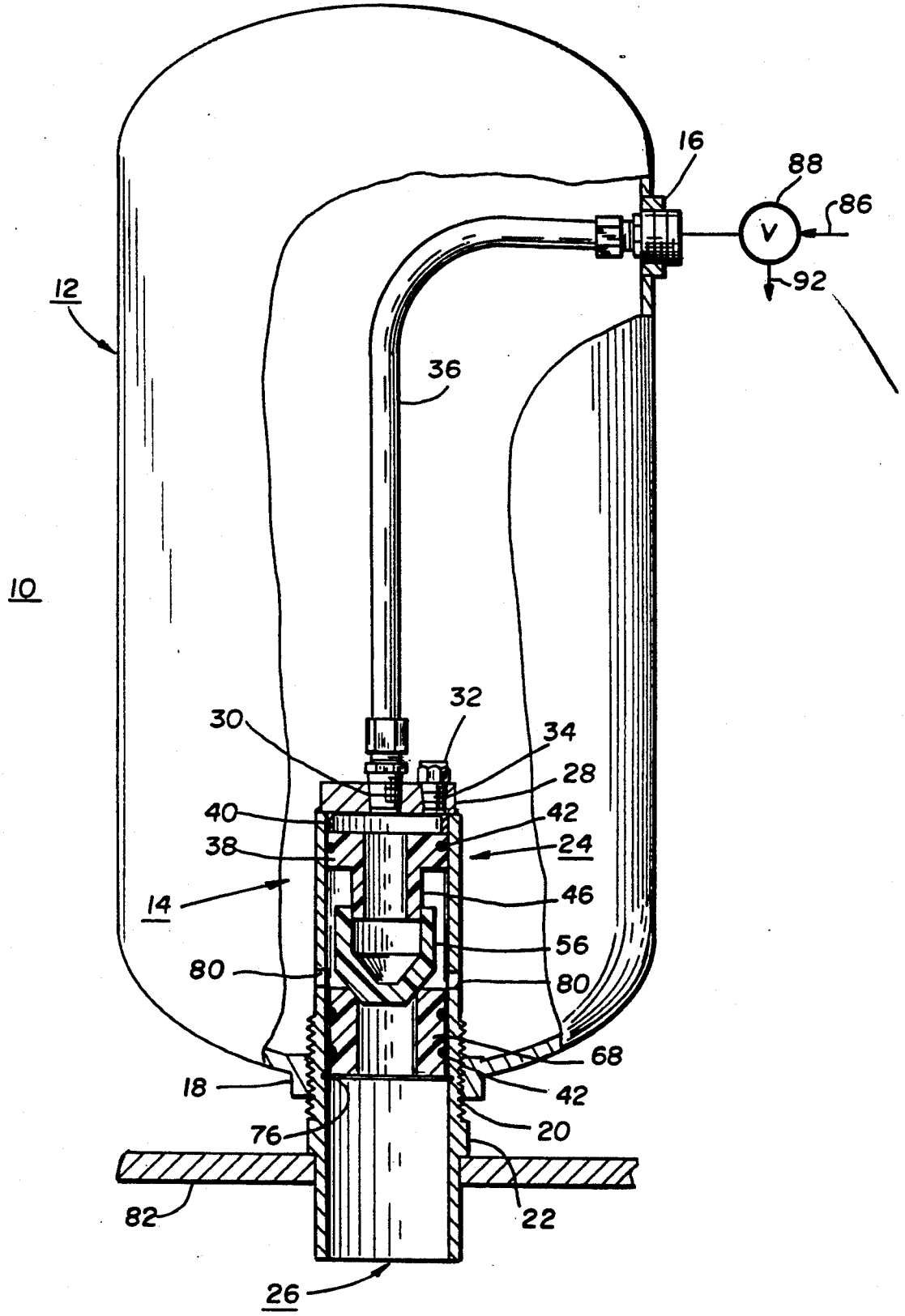
FIG. 1 represents a front elevational view, partly schematic and partly in section, of a gas accumulator and blaster apparatus of the present invention.

Referring to FIG. 1, a gas accumulator and blaster apparatus of the present invention is generally identified as 10. This apparatus includes a pressure tank 12 and a quick release valve assembly 14. The pressure tank 12 is capable of holding a volume of a gas such as air in a compressed state. The size of the tank 12 is dependent on the application and the volume of air required to perform the loosening of the granular material. Tank sizes may vary between 0.05 cubic feet and 9.33 cubic feet and are designed to withstand pressure in the range of 125 P.S.I. (Gauge).

The tank 12 is provide with an inlet port 16 and a larger outlet port 18. The quick release valve assembly 14 is removably mounted into the outlet port 18. The mounting preferably is by a threaded connection 20. The use of a threaded connection 20 allows the use of a standard pipe nipple as an elongated outer sleeve member 22. It is to be noted that the connection of the quick release valve assembly 14 is not limited to the threaded connection. For example a flange connection, compression connection, or the like may be used. The quick release valve assembly 14 is inserted into the pressure tank 12 to a predetermined depth.

This outer sleeve member 22 has a first end 24 and a second end 26. The first end 24 is closed by an end cap 28. The connection of the end cap 28 to the first end 24 must be fluid-tight. The end cap 28 is provided with a through aperture 30 and a check valve 32 mounted in a second through aperture 34. The check valve 32 is positioned to allow uni-directional flow from interior the first end 24 to and towards the interior of the tank 12. A conduit member 36 is routed interior of the tank 12 to provide a substantially fluid-tight connection between the inlet port 16 and the first end 24. This conduit member preferably is a rubber hose assembly but other suitable conduit members may be used Referring now to FIGS. 1 through 3, a guide member 38 is removably retained interior of the first end 24. This guide member 38 is held in a spaced relationship with the end cap 28 by a spacer 40. The guide member 38 carries a sealing means 42, such as an o-ring or quad ring. This sealing means 42 provides a substantially fluid-tight connection between the first diameter portion 44 of the guide member 38 and the outer sleeve member 22. The length of the first diameter portion is a matter of design selection as well as the number of sealing means 42. A shouldered portion 46 projects from one end 48 of the first diameter portion 44. The shouldered portion 46 includes a second diameter portion 50 and a predetermined length. A passageway 52 is provided in and through the guide member 38. The axis of the first diameter 44, second diameter, and the passageway 52 are in substantially concentric alignment.

A cup shaped piston member 56 is movably carried on the shouldered portion 46 of the guide member 38. The piston 56 includes an outside diameter 58, a hollow recess 60, and a tapered nose portion 62. The outside diameter 58 is sized to provide a clearance between the interior of the outer sleeve 22 and the piston 56. The hollow recess 60 is selectively sized to provide a sliding fit with said shouldered portion 46. This sliding fit between the piston 56 and the guide member 38 allows substantially free sliding movement of the piston when acted upon by gravity. The contacting surfaces of the piston 56 and the guide member 38 are provided with a precision smooth finish.

The tapered nosed portion 62 has a selectively angled chamfered edge 64 formed thereon. An annular seat member 68 is removably retained interior of the outer sleeve 22 intermediate the first end 24 and the second end 26. The seat member 68 includes a selectively sized bore 70 there-through. The through bore 70 has at least one chamfered end 74. This chamfered end 74 is preferably sized and angled to provide a substantially fluid-tight seal between the piston 56 and the annular seat member 68.

At least one sealing means 42 is carried in and on the seat member 68 to provide a substantially fluid-tight seal between the seat member 68 and the outer sleeve 22. The seat member 68 is retained and positioned interior of the outer sleeve member 22 by and with a removable retaining means 76, such as a commercially available retaining ring. Of course other suitable retaining means may be used.

At least one transverse aperture 80 is provided through the wall of the outer sleeve member 22. The quick release valve must be positioned within the tank 12 to provide communication between the transverse aperture 80 and the interior of the tank 12.

The second end 26 of the outer sleeve member 22 is preferably attached to a mounting flange 82.

USE AND OPERATION

Referring again to FIG. 1, the gas accumulator and blaster apparatus 10 is connected to a source of a compressed gas indicated as 86. This source of compressed gas 86 may be permanently or temporarily attached. A directional control valve 88 is used to selectively control the flow of gas 86 into the apparatus 10. This control valve 88 is preferably of a three-way design and may be manually operated or automatically operated.

The apparatus 10 is preferably mounted at or near a vertical alignment. The second end 26 is connected to the interior of the storage bin, not shown. The flange member 82 provides a mounting support for the apparatus 10. This flange 82 may be attached directly to the storage bin or to a mounting stand.

Figure 3:
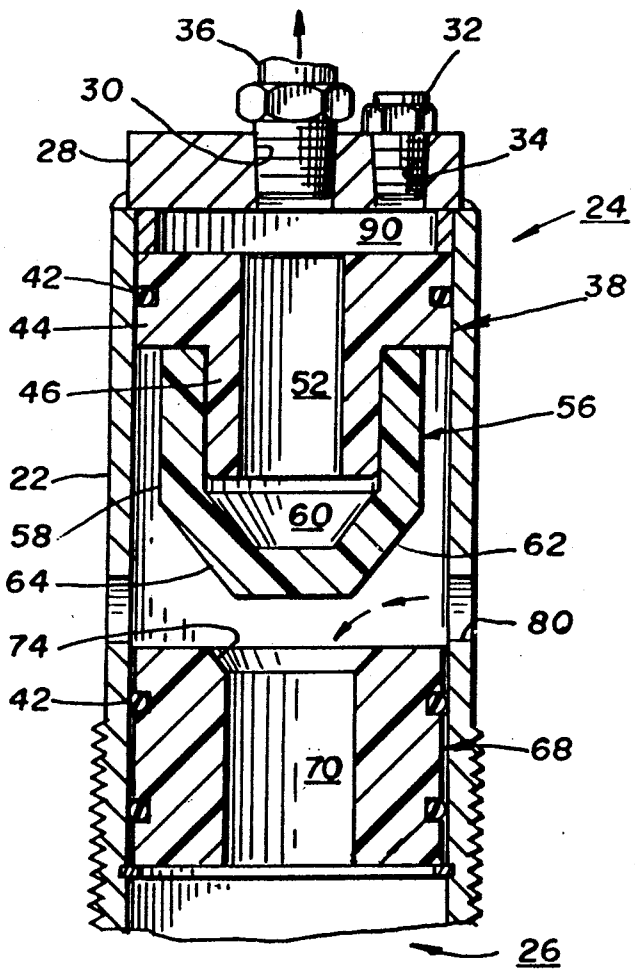
FIG. 3 represents a front sectional view of the quick release valve of the present invention, this view in the enlarged scale of FIG. 2 and showing the valve in an open position.
Figure 2:
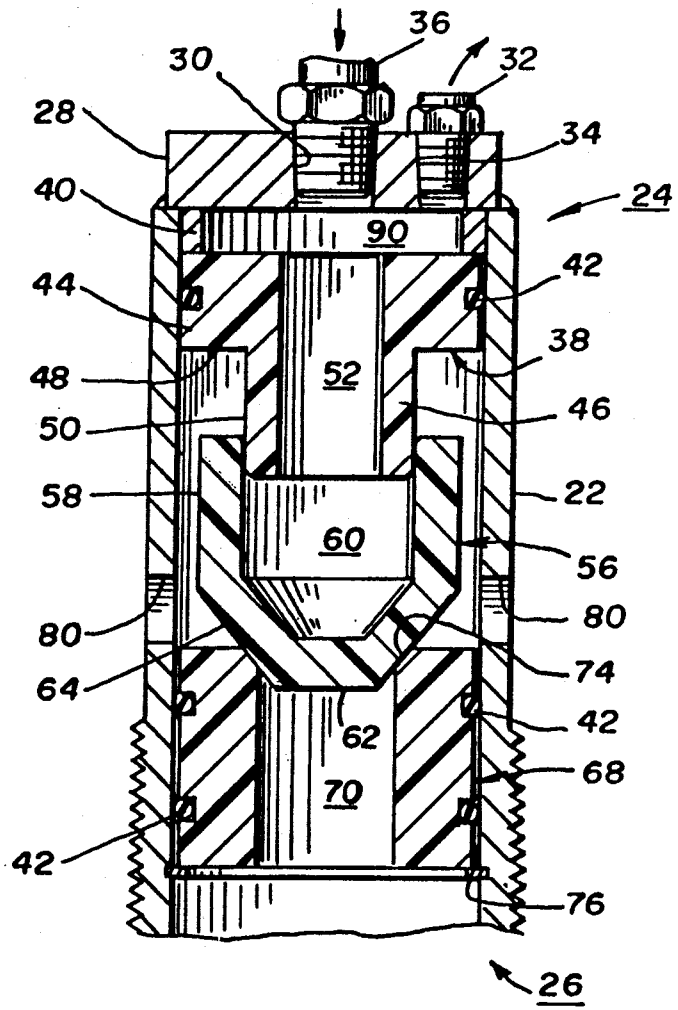
FIG. 2 represents a front sectional view, in an enlarged scale of the quick release valve portion of the present invention, this view showing the valve in a closed position

Referring now to FIGS. 1 through 3, the directional control valve 88 is placed in a filling mode when it is desired to fill the tank with a compressed gas from source 86. The compressed gas is carried to the tank by way of the conduit 36 and the quick release valve 14. The piston of the quick release valve 14 is positioned in the closed position as shown in FIG. 2. The compressed gas entering the quick release valve 14 fills the space 90, passageway 52, and hollow recess 60. The compressed gas enters the tank 12 by way of check valve 32. The action of the check valve 32 permits flow in only one direction.

The compressed gas in the tank enters the first end 24 of the quick release valve by way of transverse apertures 80. The sealing action between the piston 56 and the seat member 68 substantially stops any gas from entering the second end 26 of the quick release valve 14. After the tank 12 is filled to a predetermined pressure the control valve 88 may be operated to an exhaust mode, with the flow as indicated by 92.

The blasting action of the apparatus 10 occurs as and when the control valve 88 is placed in a condition to exhaust the compressed gas from interior of the conduit as well as space 90, passageway 52, and hollow recess 60. The piston 56 is lifted to an open condition as shown in FIG. 3. The movement of the piston 56 to the open condition is caused by the imbalance of forces in the quick release valve 14. It has been found that the lifting action on the piston 56 is aided by the quick exhaustion of the gas holding the piston in a closed condition.

Referring again to FIG. 1, the blasting operation includes allowing the compressed air in the tank 12 to pass through transverse aperture 80, into the bore 70, and into the storage bin by way of the second end 26.

The piston 56 will move to a closed position immediately upon the absence of a lifting force which is created by the flow of gas from the tank 12. After the piston 56 returns to a closed position, the cycle may be repeated.

The piston 56 preferably is manufacture of a lightweight material. The guide member 38 and the seating member 68 may be made of the same material. Preferably the piston 56, guide member 38, and the seating member 68 are made from a thermoplastic material such as a polymide. It is also recommended that the material used be impregnated with a lubricant.

It should be noted that the blasting action or emptying of the tank of a compressed gas may occur in as little as one-quarter of a second. It is to be also noted that conventionally blaster apparatus use compressed air as the gas.

Terms such as "left", "right", "up", down", "bottom", "top", "front", "back", "in", "out", "open", "closed" and the like are applicable to the embodiments shown and described in conjunction with the drawings. These terms are merely for the purpose of description and do not necessarily apply to the position in which the gas accumulator and blaster apparatus of the present invention may be employed.

While these particular embodiments of gas accumulator and blaster apparatus have been shown and described, it is to be understood that the invention is not limited thereto and protection is sought to the broadest extent the prior art allows.

What is claimed is:

1. A gas accumulator and blaster apparatus for selectively and intermittently fluidizing granular material being contained in storage bins, said apparatus including:

(a) a pressure tank for storing a compressed gas, said pressure tank having a selectively located inlet port and a selectively located outlet port;

(b) a quick release valve adapted for removable mounting in said outlet port, said quick release valve having a selected portion interior of said pressure tank, said quick release valve including:

(b1) an elongated outer sleeve member, said outer sleeve member having a first end a second end, said first end having an end cap fastened thereon in a substantially fluid-tight relationship, said first end also having a check valve provided therein and thereon for allowing uni-directional flow of a pressurized gas from interior of said first end of said outer sleeve member into said pressure tank.

(b2) a guide member adapted for being retained interior of said outer sleeve member at a selectively spaced relationship with said end cap, said guide member including a first diameter portion, and a shouldered portion, said first diameter portion adapted for providing a substantially fluid-tight seal with an interior surface of said outer sleeve member, said shouldered portion having a selectively sized second diameter, said shouldered portion projecting from an end of said first diameter portion in a direction distal said end cap, said guide member having a selectively sized circular passageway therethrough, said first diameter portion, said second diameter of said shouldered portion, and said passageway being in a substantially concentric alignment;

(b3) a movable substantially cup-shaped piston member, said piston member including a selectively sized outside diameter, a hollow recess, and a nose portion, said nose portion having a selectively angled chamfered edge, said hollow recess being selectively sized to provide a sliding fit with said shouldered portion of said guide member, said hollow recess having a selected depth for allowing said piston member to telescopically move a predetermined amount onto said shouldered portion of said guide member, said outside diameter being selectively sized to provide a clearance fit with said interior surface of said outer sleeve member;

(b4) an annular seat member selectively located intermediate said first end and said second end of said outer sleeve member, said seat member adapted for being removably retained within said outer sleeve member, a sealing means for providing a substantially air-tight connection between said annular seat member and said outer sleeve member, said seat member having a selectively sized bore therethrough, said bore having at least one chamfered end, said chamfered end being adapted to mate with the chamfered edge of said nose portion of said piston member for providing a substantially fluid-tight seal as and when desired;

(b5) at least one transverse aperture in and through the wall of said sleeve member, said transverse aperture being located in a selected relationship with said chamfered end of said seat member;

(c) a conduit member for connecting said inlet port with a through aperture located in said end cap, said conduit member providing a substantially fluid-tight conduit for selectively filling said accumulator and blaster apparatus with said gas and then subsequently exhausting said gas from interior of said piston member and said guide member; and (d) wherein said quick release valve is disposed for allowing said cup shaped piston member to rest on said chamfered end of said annular seat member by gravity for stopping gaseous communication between said transverse aperture and said selectively sized bore in said seat member, said quick release valve further adapted for providing a greater seating force between said piston member and said seat member as and when a gas under pressure is introduced into said guide member and into said hollow recess in said piston member, said quick release valve adapted for quickly urging said piston member away from said seat member as and when said gas under pressure is exhausted from said recess, said guide member, and said conduit; said urged away piston member providing gaseous communication between said transverse aperture and said through bore of said seat member, said communication allowing for any gas under pressure in said pressure tank to escape through said second end.

2. A gas accumulator and blaster apparatus as recited in claim 1 wherein said check valve is removably fastened in a second aperture in said end cap.

3. A gas accumulator and blaster apparatus as recited in claim 1 wherein said sealing means includes a continuous o-ring carried in a selectively located annular groove.

4. A gas accumulator and blaster apparatus as recited in claim 1 wherein said fluid-tight seal of said first diameter portion of said guide member is a continuous o-ring carried in a selectively located annular groove.

5. A gas accumulator and blaster apparatus as recited in claim 1 wherein said conduit is a flexible rubber hose assembly.

6. A gas accumulator and blaster apparatus as recited in claim 1 wherein said elongated outer sleeve member is a standard sized pipe nipple.

7. A gas accumulator and blaster apparatus as recited in claim 6 wherein said quick release valve is threaded into said outlet port.

8. A gas accumulator and blaster apparatus as recited in claim 1 wherein said guide member and said piston member are made from a thermoplastic material.

9. A gas accumulator and blaster apparatus as recited in claim 8 wherein said thermoplastic material is from the polymide family.

10. A gas accumulator and blaster apparatus as recited in claim 9 wherein said guide member and piston member are impregnated with a suitable lubricant.

11. A gas accumulator and blaster apparatus as recited in claim 1 which includes a flange member selectively fastened to said second end of said quick release valve, said flange member adapted for mounting said apparatus next to a storage bin.

12. A gas accumulator and blaster apparatus as recited in claim 1 which includes a directional control valve for selectively introducing said gas into or away from said conduit.

* * * * *